United States Patent [19]

Sanders et al.

[11] 4,308,860

[45] Jan. 5, 1982

[54] SCALP MASSAGING IMPLEMENT

[76] Inventors: Estelle W. Sanders, 1815 Sudbury Rd., NW., Washington, D.C. 20012; Lawrence J. Goffney, Jr., 651 E. Jefferson Ave., Detroit, Mich. 48226

[21] Appl. No.: 47,265

[22] Filed: Jun. 8, 1979

[51] Int. Cl.[3] ..... A61H 7/00

[52] U.S. Cl. ..... 128/62 R

[58] Field of Search ..... 128/62 R, 62 A, 67, 128/60

[56] References Cited

U.S. PATENT DOCUMENTS

| | | | |
|---|---|---|---|
| 1,465,522 | 8/1923 | Linday | 128/62 A |
| 2,103,083 | 12/1937 | Lynch | 128/67 |
| 2,686,325 | 8/1954 | Silver | 401/7 |
| 3,016,763 | 1/1962 | Albert | 273/81 R |

FOREIGN PATENT DOCUMENTS

| | | | |
|---|---|---|---|
| 153709 | 7/1938 | Fed. Rep. of Germany | 128/62 A |
| 909768 | 4/1954 | Fed. Rep. of Germany | 128/67 |

*Primary Examiner*—V. Millin

[57] ABSTRACT

A scalp massaging implement includes a plurality of flexible tines with free ends radiating from the outer surface of a fingertip covering. In one embodiment the tines are cupped at their free ends. The fingertip covering has an inner surface over which cupped projections are distributed. A fingernail receptacle is provided in the inner surface. The tines, the fingertip covering, and the cupped projections are preferably constructed of a resilient material so that the tines can flex and return to their original shape and the fingertip covering, with cupped projections, can stretchably receive a human finger, with fingernail, for suctional adherence thereto.

3 Claims, 4 Drawing Figures

SCALP MASSAGING IMPLEMENT

BACKGROUND OF THE INVENTION

This invention relates generally to the art of scalp massaging devices, and, more particularly, to mechanical devices for use with the fingers of human hands to agitate and massage the scalp and hair when the scalp and hair are washed.

Some conventional methods of washing scalp and hair do not employ the use of devices other than the fingers and nails of human hands. By such methods, a solvent—e.g., soap or shampoo—is massaged by the fingers and nails against the scalp and the hair shafts, mechanically cooperating with chemical means to loosen dandruff and dirt, which can then be flushed away in solution with water. Two obvious disadvantages are associated with such conventional methods.

One disadvantage is that the nails of the human hand tend to abrade the scalp more than necessary to loosen dirt and drandruff. Accordingly, abrasions sometimes develop into small ulcers on a part of the body, the head, where germs are apt to be present. This can result in scalp and hair diseases with a further result of patchiness or complete baldness. It would be ironic, indeed, if methods used to bring about hair beauty result in no hair at all—the beautician's dread, alopecia!

The other disadvantage is that use of the nails as abrasives damages the nails. Interest in nail beauty usually accompanies interest in hair beauty. Again, it would be ironic if methods used in beautifying the hair result in uglifying the nails.

One means of overcoming these disadvantages is to orient the fingers in a way that allows only the tips of the fingers to be contiguous to the scalp. But such manipulative dexterity, where at all possible, is particularly tiring to the hands. And, even so, the friction of the skin of the fingers against the scalp lacks adequate abrasiveness for mechanically agitating adhesive particles to loosen them from the scalp.

DISCUSSION OF PRIOR ART

Some devices may be used to replace the mechanical leverage of the fingers and nails. One such device is disclosed in U.S. Pat. No. 871,121, issued to Fernand E. D'Humy. The device is a brush-like massaging implement having a multiplicity of flexible rubber fingers, instead of brush bristles, which slant from the brush-like handle base in differing directions. When pressed upon the skin, the convergent and divergent free ends of the slanting fingers pinch and spread the skin in a massaging action that is enhanced by the lateral movement of the complete implement.

Although the D'Humy patent teaches a device for manually massaging the skin, it could well be used for massaging the scalp and hair. An advantage this device would have over the use of the fingers and nails of the human hand is that the rubber fingers can engage the scalp without ulcerating abrasiveness. Another advantage is that the fingers can engage the scalp with dynamic moments when each flexible finger is bent so as to experience internal straightening forces which cause the rubber finger to rebound with its free end accelerating slidably against the scalp. This characterizes a vigorous massaging action, advantageously quaking the scalp to loosen foreign matter and stimulating the scalp to receive humoral nutrition for hair growth.

One significant disadvantage of the D'Humy device is that the rubber fingers do not respond in dynamic cooperation as to the fingers of the hand; also inherent in the art of manipulative scalp massaging is the concept of fingers cooperating with sufficient strength to attain dynamic leverage.

Another device that may be used as a substitute for the fingers and nails is disclosed in U.S. Pat. No. 2,959,167, issued to Jean Leclabart. This device is also equipped with rubber fingers for frictional contact against the scalp, but the fingers are relatively rigid as compared to the above-mentioned D'Humy patent. Each of two sets of fingers is carried at the end of one of two arms that originate in a common casing. The two arms are mounted in oscillatory fashion and directed in such a manner that, when the fingers are contiguous with the scalp and the casing is pressed toward the scalp, the ends of the arms converge to cause the opposite sets of fingers to cooperate in pinching the scalp. When the pressure is released, a spring mounting in the casing causes the ends of the arms to diverge. Thus dynamic leverage is achieved with two combined actions, pinching the scalp and massaging it.

While the Leclabart device allows for rapid massaging to be carried out without external assistance, the device suffers from certain disadvantages, particularly when it is used in washing the hair. One disadvantage is associated with the mechanical components necessary for the oscillatory mounting of the arms. The more durable components would most likely be fashioned of materials susceptible to chemical attack when exposed to water and soap solvents.

Yet a more notable disadvantage is that pinching is achieved in one direction at a time, and no spreading of the scalp is achieved. The advantage of using the hand is that pinching may be achieved from several directions simultaneously, and spreading results from the reflex of the fingers.

A final device for discussion as prior art is disclosed in U.S. Pat. No. 2,547,243, issued to Myrtle A. Amer. This device attempts to simulate the action of the fingers of the human hand by using rubber typed, artificial fingers. But the device has the shortcomings of having less dynamics than the above-mentioned patents.

SUMMARY OF THE INVENTION

Briefly described, the present invention comprises a scalp massaging implement that includes a rubber fingertip covering. The covering has radiating from the outer surface of its palm side and its tip a plurality of flexible rubber tines. The end of each tine is preferably cupped for suction when placed against the scalp. The inner surface of the covering also has a plurality of cupped projections, but of greater shaft diameter than the tines, and of negligible shaft length.

The preferred embodiment is to be used in quantity so that as many fingertips as desired to be covered may be so covered by the device.

Accordingly, it is the primary object of our present invention to provide a durable device for manipulatively massaging the scalp when washing the scalp and hair, with the advantage of using the fingers of the hand in cooperation to achieve efficient dynamic leverage. Another object of our invention is to protect the nails of the hand from being damaged while the fingers cooperate in dynamic leverage to quake the scalp. Still another object of our invention is to insulate the scalp against the abrasiveness of the nails as the fingertips engage the scalp in dynamic leverage. Yet another object of our invention is to allow the fingers of the hands to cooperatively engage the scalp with dynamic leverage to massage the scalp, but with non-abrasive tines contiguous with the scalp, the tines continually in flexible deformation so that dynamic moments are set up within deformed tines causing them to rebound slidably against the scalp to enhance the massaging of the scalp.

Other objects, features and advantages of the present invention will become apparent upon reading the following specification, when taken in conjunction with the accompanying drawing.

DESCRIPTION OF A PREFERRED EMBODIMENT

Figure 1:
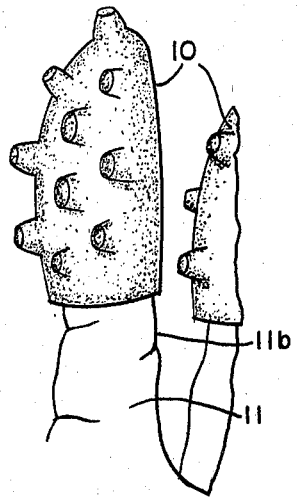
FIG. 1 is a perspective of the implement showing it attached to a finger of the human hand.
Figure 2:
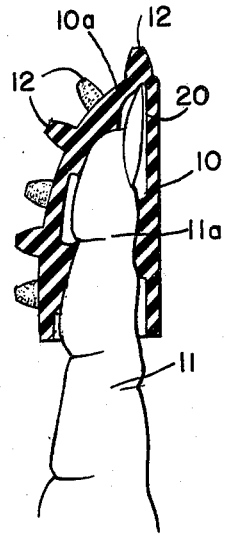
FIG. 2 is sectional view of the implement, with an elevational view of a finger therein.

Referring now in more detail to the drawing, in which the numerals indicate like parts throughout the several views, FIGS. 1 and 2 show a fingertip covering 10, thinly constructed of a resilient material—preferably rubber, so that is may stretch to receive a tip of a finger 11, and secure itself over the fingertip and the distal finger joint 11*a*. The covering 10 extends short of the proximal finger joint 11*b* (or beyond the proximal and only joint of the thumb). A fingernail receptacle 20 is particularly illustrated in FIG. 2. FIGS. 1 and 2 also show the plurality of flexible tines 12 made of the same material as the covering.

It is desirable that the tines 12 radiate only from the palm side of the implement 10 as it is worn on the finger 11, because nail side tines may unnecessarily entangle the hair. But this is not a limitation on the invention.

The fingernail receptable 20 is shown embedded in the fingertip covering 10, as both are illustrated in FIG. 2 as a novel means of protecting the fingernail. FIG. 2 shows the contruction of the fingertip covering 10 to be relatively thick at its crown 10*a* when compared to the thin construction of its sides. The thicker crown 10*a* will absorb force and shock directed toward the fingernail, which is protected by the combination of the thick crown 10*a* and the fingernail receptacle 20.

Figure 3:
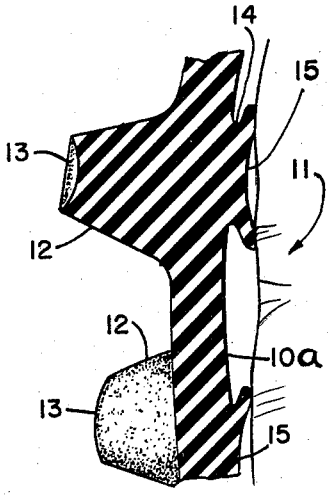
FIG. 3 is a fragmental cross-section of the implement, three of the outer tines, and two of the inner, cupped projections.

Referring now to FIGS. 2 and 3, it is illustrated that each of the flexible rubber tines 12 is preferably cupped at 13 on its free end for time to time suctional adherence to the scalp. The inner surface 10*a* of the covering 10 also has a plurality of cupped 15 projections 14, but the shafts of these projections 14 are of negligible length. The cupped ends 15, however, are preferably of greater diameter than the cupped ends 13 of the tines 12. The cupped projections 14 provide a novel means of suctorial adherence for the fingertip covering 10 to the finger 11. The projections 14 are juxtaposed to the finger 11, with their axes perpendicular to the axis of the finger 11, and are distributed on both sides—proximally and distally—of the distal finger joint 11*a*. The projections 14 are of sufficient renitent thickness, but also of sufficient pliableness and resilience, to shape themselves into hyperboloidal contact with the cylindrical surface of the finger while expelling air so as to create a vacuum for suction to finger 11. Because of the distribution of the projections, some cupped ends 15 are from time to time in greater suctorial contact than others as the finger 11 is flexed about the distal joint 11*a*. Both the suctional adherence of the tines 12 to the scalp and the projections 14 to the finger 11 are enhanced in a soap and water medium.

Figure 4:
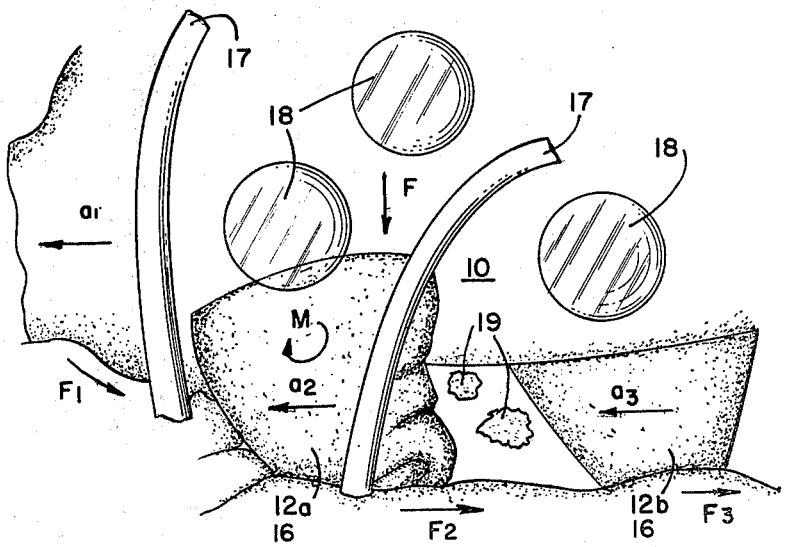
FIG. 4 is a fragmental diagram of the implement against the scalp with tines in flexible deformation. Force, velocity, and moment vectors serve to indicate the principles of dynamic leverage served by the implement.

FIG. 4 illustrates some advantageous features of the implement in use not readily apparent from its structure. When washing the hair in a medium of soap and water, as represented by 18, the implement is preferably worn on each finger and the thumb of both hands as discrete implements, as implements joined together by attaching means—e.g., flexible, elongated webs or string—, or as implements integrally structured into a glove—as an improvement over such gloves used in washing the hair. The fingers press into the scalp 16 achieving natural leverage as represented by the downward force vector $F_1$. As the fingers are accelerated across the scalp 16 as represented by the vector $A_1$, in the natural manner employed in washing the hair, the flexible tines 12 engage the scalp 16 and hair 17. The acceleration of the covering 10 is resisted by frictional forces represented by the force vector $F_1$.

Some of the tines 12*a* deform so as to experience internal bending moments as represented by the moment vector M. Thus the tines 12*a* are accelerated $A_2$ differently than the covering 10 when the voluntary manipulative action of the fingers push the implement 10 against the resisting frictional forces at the scalp/hair and rubber interfaces. These frictional forces are represented by the force vector $F_2$.

Other tines 12*b* engage the scalp with their cupped free ends 13 so that they experience yet a different acceleration $A_3$ and different frictional forces $F_3$.

Additional accelerations result from the resilience of the tines as they resume their normal form after deformation, accelerating slidably against the scalp and hair.

Continuous stroking of the fingers achieves a combination of dynamics and leverage, or dynamic leverage, with the cooperative action of the fingers and tines stretching, pinching and quaking the scalp to mechanically loosen dirt and dandruff, as represented by 19 in FIG. 4, and stimulates the scalp to receive humoral nutrition.

We claim:

1. A scalp massaging implement comprising:

a fingertip covering;

a plurality of flexible tines radiating from the outer surface of the fingertip covering and having free ends for pinching, spreading, and quaking the scalp; and a plurality of cupped projections distributed over the inner surface of said fingertip covering, said cupped ends constructed of a pliable and resilient material for forming a hyperboloidal contact with the cylindrical surface of a human finger and constructed in renitent thickness to seal said cupped ends in suctorial hyperboloidal contact to said finger.

2. A scalp massaging implement as described in claim 1 wherein the fingertip covering and the plurality of cupped projections are constructed of a resilient material to stretchably receive a human finger and adhere in suction thereto.

3. A scalp massaging implement as described in claim 2 wherein the flexible tines are provided with cupped free ends for enhancing adherence of said free ends to the scalp.

* * * * *